United States Patent [19]

Maitenaz

[11] 3,962,561

[45] June 8, 1976

[54] CATALYTICALLY ASSISTED PYROLYTIC SELF-CLEANING OVEN

[75] Inventor: Paul Maitenaz, Orleans, France

[73] Assignee: Compagnie Europeenne pour l'Equipement Menager, CEPEM, Paris, France

[22] Filed: July 16, 1974

[21] Appl. No.: 489,022

[30] Foreign Application Priority Data

July 17, 1973 France ..... 73.26140

[52] U.S. Cl. ..... 219/391; 23/288 F; 126/19 R; 126/190; 219/393

[51] Int. Cl.[2] ..... H05B 1/00; A21B 1/00; A21B 1/22

[58] Field of Search ..... 23/288 F; 117/70 B, 117/97, 129; 252/471; 219/391, 392, 393, 395–397; 126/190, 19 R

[56] References Cited

UNITED STATES PATENTS

| | | | |
|---|---|---|---|
| 3,059,089 | 10/1962 | Swisher | 219/391 |
| 3,460,523 | 8/1969 | Stiles et al. | 126/19 R |
| 3,553,425 | 1/1971 | Fry | 219/393 |
| 3,566,855 | 3/1971 | Morgan | 126/19 R |
| 3,576,667 | 4/1971 | Lee | 117/129 |
| 3,627,560 | 12/1971 | Morgan | 117/70 B |
| 3,702,112 | 11/1972 | Keppler | 126/19 R |
| 3,718,498 | 2/1973 | Denny et al. | 117/97 |
| 3,739,146 | 6/1973 | Gillion | 219/393 |
| 3,791,995 | 2/1974 | Chay | 252/471 |

*Primary Examiner*—A. Bartis
*Attorney, Agent, or Firm*—Sughrue, Rothwell, Mion, Zinn & Macpeak

[57] ABSTRACT

A pyrolytic self-cleaning oven includes means for heating a thermally insulated oven muffle to a temperature of about 400° to 500° C. to clean the walls thereof by pyrolysis. In order to facilitate the pyrolytic self cleaning action and to reduce the overall time of high heat application to the oven muffle to effect that cleaning, the coldest regions of the muffle, including the inner surface of the access door and narrow zones of the muffle walls immediately surrounding the muffle access opening and the air inlets to the muffle, are provided with a coating of catalytic enamel capable of withstanding the pyrolytic cleaning temperature.

3 Claims, 2 Drawing Figures

CATALYTICALLY ASSISTED PYROLYTIC SELF-CLEANING OVEN

BACKGROUND OF THE INVENTION

1. Field of the Invention

This invention relates to a self-cleaning oven and more particularly to an oven for electric or gas kitchen ranges.

2. Description of the Prior Art

With a view to dispensing with the cleaning operation for ovens which makes use of either solvents which dissolve only certain deposits which are not yet carbonized, or mechanical agents such as powders, metallic or artificial fibers, an operation which is long and not easy, it is a known practice to use self-cleaning ovens. Two types are used; the catalytic self-cleaning oven and the pyrolytic self-cleaning oven. In the catalytic self-cleaning oven, cleaning is effected normally during cooking. It is nevertheless possible, if the dirt deposits are great, to effect a cleaning operation after cooking, the temperature of the oven remaining lower than 350° C, this not requiring a very great reinforcing of the heat-proofing of the oven and not requiring the use of a door safety device, as is the case in pyrolysis, but requiring time for the removal of the dirt deposits by catalysis alone.

In the pyrolysis oven, on the contrary, cleaning is effected when not cooking, at a temperature higher than 400° C and generally comprised between 400° and 500° C, so as to effect a cleaning of all the walls, including the regions of the walls which are the coldest, for there are always, in an oven, differences in temperature between the walls or between the various points of a same wall. Lastly, as there is no self-cleaning during cooking, it is necessary to proceed, very often, with the cleaning operation when not cooking, an operation which immobilizes the oven for a fairly long period and causes a certain power consumption.

The present invention proposes to overcome the disadvantages of catalytic self-cleaning ovens or pyrolytic self-cleaning ovens.

SUMMARY OF THE INVENTION

The oven according to the invention is of the pyrolytic self-cleaning type. It is characterized in that the inside walls of the oven are lined with catalytic enamel at least in the coldest regions. According to another characteristic, all the walls of the oven are completely lined with catalytic enamel.

The oven according to the invention affords numerous advantages to the user, without having a construction different from that of usual pyrolytically cleaned ovens.

The oven according to the invention makes possible, due to the catalytic enamel in the cold regions, the cleaning of those regions, by catalysis, whereas the other walls are cleaned by pyrolysis, their temperature being higher, in the order of 450° C, for example, this making it possible, moreover, to lower the temperature on the outside walls of the oven, if heat-proofing for an oven operating at 500° C or more is adopted.

It is possible to cover only the inside face of the door of the oven with catalytic enamel, but is is known that it is very difficult to provide perfect fluid-tight sealing between the door and the entrance of the oven, so that at the place of contact between the door and the entrance of the oven, inflow of air which cools the door and the walls of the oven are produced at the entrance to the latter. It is possible therefore, to line the walls on the periphery of the entrance of the oven, as well as the inside face of the door, with a strip of catalytic enamel.

As the oven according to the invention is of the pyrolytically cleaned type, it comprises, like all ovens of that type, fresh air inlets, the gases and smoke being removed through an opening in the upper part of the oven and passing through a purifying catalyst before being discharged outwards. It is therefore possible to line the regions of the walls surrounding the fresh air inlets with catalytic enamel, these inlets being quite evidently cold regions of the oven.

BRIEF DESCRIPTION OF THE DRAWINGS

Various non-limitative embodiments of the invention will be described hereinafter with reference to the accompanying drawings, in which.

DESCRIPTION OF THE PREFERRED EMBODIMENT

Figure 1:
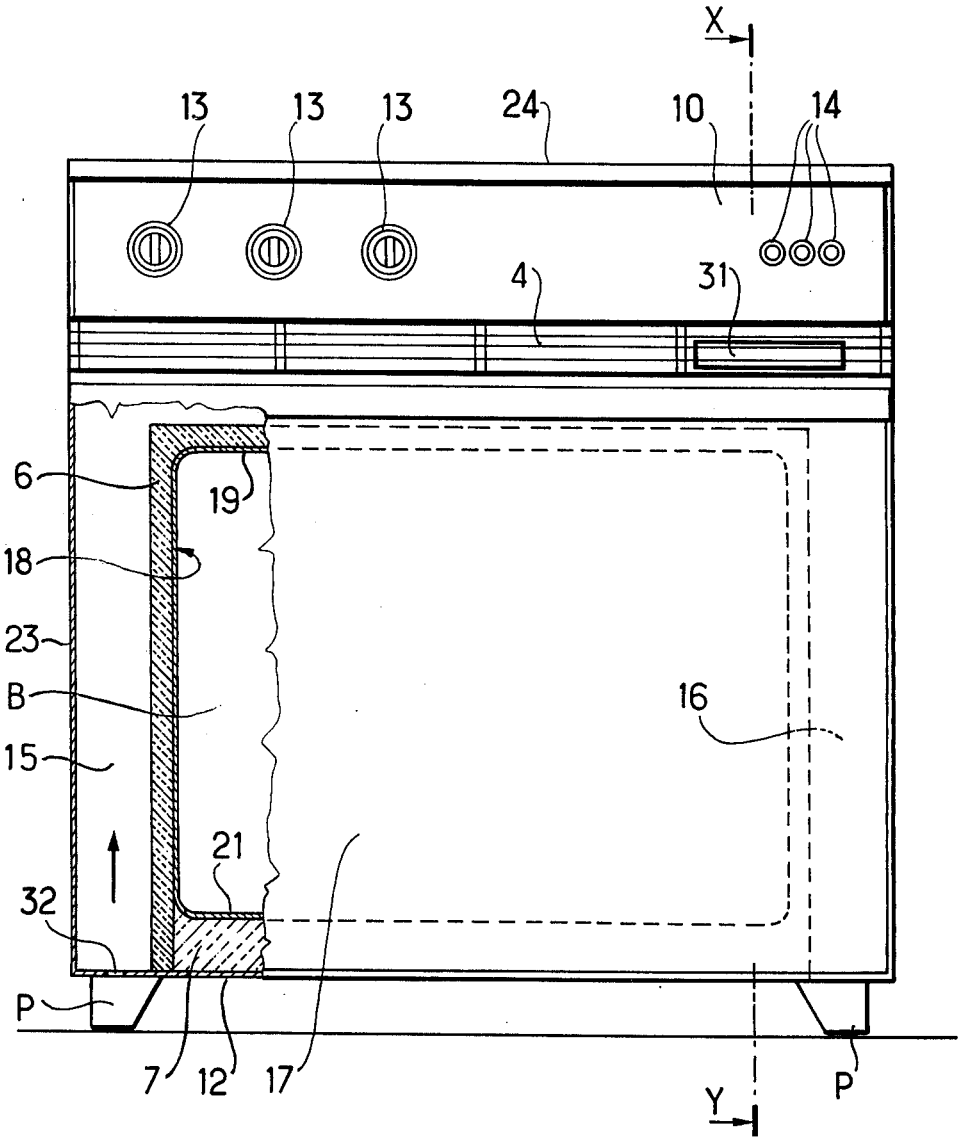
FIG. 1 is a front view of an oven incorporating the present invention.

FIG. 1 represents the front view of an oven implementing the present invention. It comprises a muffle wall 19 insulated by way of an insulating layer 6 on its upper part and sides and an insulating layer 7 on its lower part and rear. The oven is closed by means of a door 17 and defined by the lateral metal sheets 23; an upper sheet 24 and a lower perforated sheet 12 having openings 32 therein. The oven rests on a surface by way of the feet P. The following elements are located on the front of the oven.

Its upper part carries a decorative strip 10 behind which is located a compartment containing the electrical apparatus which is directly above the door of the oven. A grid 4 is provided for the evacuation of air after it has circulated about the sides and upper wall of the muffle B. A fume evacuation conduit connected to a catalysis element situated at the upper part of the muffle and the end 31 of which opens behind the grid 4, is designed to evacuate fumes from the inside of the muffle B. A space is provided on each side of the muffle B between the heat insulating layer 6 and the lateral sheets 23; this space forming the circulation conduits 15 and 16 for the fresh air which is introduced by way of the lower part of the oven via the opening 32 in the lower sheet 12. The air which circulates in the circulation conduits is evacuated through the grid 4.

The operation of the oven is controlled by the control knobs 13 and indicator lights 14 indicate that the oven is operating.

Figure 2:
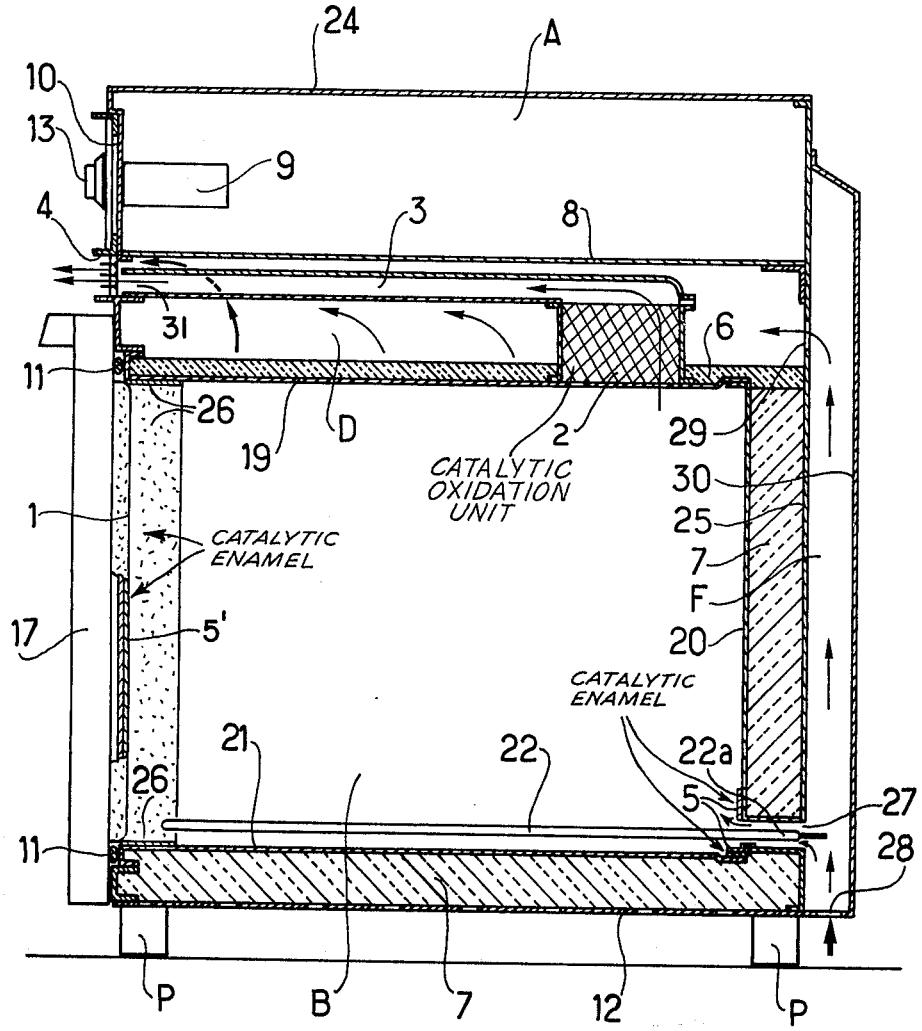
FIG. 2 is a sectional view along the line II - II of the oven shown in FIG. 1.

The various cooling lines mentioned above are more apparent in FIG. 2 which shows a side view of the oven represented in FIG. 1 along the line XY. The same elements as those shown in FIG. 1 are obviously designated by the same reference numbers. The muffle itself is designated by B. A compartment A contains the electrical apparatus 9, this compartment being defined by an upper metal sheet 24 and a separating sheet 8 which separates this compartment and the heat insulating layer 6 of the upper wall 19 of the muffle and defines an evacuation chamber D through which the cooling air is passed to the grid 4 for evacuation. The oven is closed at the rear by a rear sheet 25; a rear cover 30 defines, with the rear sheet 25, a rear conduit F; this cover having a lower opening 28 at its base for the admission of fresh air.

The oven is heated, inter alia, by way of an electric bed plate 22, each end of which 22a crosses the heat insulating layer 7 located between the rear wall 20 of the muffle B and the rear sheet 25. The wall 20 and the sheet 25 are perforated and the unit which defines a muffle opening 27 for the admission of fresh air to the inside of the muffle B about the lower part of the muffle is insulated by an insulating layer 7 located between the lower wall 12 of the muffle and the lower sheet 12. The heat insulating layer 6 above the upper wall 19 of the muffle constitutes the lower part of the evacuation chamber D.

Fumes from inside the muffle, particularly those which are produced during cleaning, pass into the catalytic oxidation unit 2 and are passed through the fume evacuation conduit 3 at the front of the oven where they are evacuated through the grid 4 where the end 31 of the fume evacuation conduit is located.

The zones 5 of the rear wall 20 of the muffle which are situated about the ends **22*a* of the resistor bed 22 are coated in catalytic enamel as these are actually the coldest regions of the oven since the fresh ventilating air for the oven is admitted in this region to permit evacuation during the cleaning operation of the fumes given off by the residues deposited on the walls. Likewise, the inner face 1 of the door 17 which is a cold zone of the oven, particularly on its periphery, in spite of the presence of a sealing joint 11, may also be covered in catalytic enamel as at 5'. It is also possible to coat with catalytic enamel the region 26 of the end of the muffle B which is situated close to the door 17. This region 26** is practically a few centimeters in width, preferably between 3 and 5 centimeters in width.

The coldest regions of the oven are coated with catalytic enamel according to the invention to insure perfect cleaning of these regions during the operation of cleaning by pyrolysis. It is also feasible to coat all the walls of the oven with catalytic enamel, including the inner side of the door.

When all the walls are lined with catalytic enamel, the oven then has the accumulated advantages of catalysis and pyrolysis. Indeed, the presence of catalytic enamel insures self-cleaning of the oven when cooking; it is not necessary, except evidently in the case of great dirt deposits by spilling, for example, to proceed with pyrolytic cleaning after each cooking operation, this hence making the oven available. The number of pyrolytic cleaning operations being small, this causes a smaller expense of energy for cleaning. As the catalytic enamel adds its action to that of the temperature which causes the destruction of dirt deposits by pyrolysis as is already known, this makes it possible to shorten the duration of the cleaning operation and consequently to reduce further the expense of energy.

It must be understood that the oven according to the invention, being of the pyrolysis type, will comprise usual protection means for this type of oven.

The walls or regions of walls are lined with a catalytic enamel withstanding the cleaning temperature; it is possible, for that purpose, to use, for example, X S 52 catalytic enamel made by Society Ferro, which permits operation at 450° C. It is of course possible to use any other enamel in trade capable of withstanding that temperature and, more particularly, any enamel bearing a higher temperature if required.

What is claimed is:

1. In a cooking oven which is self-cleaned by pyrolysis, and which includes front, rear, top, bottom and opposed side walls forming the oven muffle, and wherein said oven further includes means for thermally insulating said oven muffle walls, means for heating said oven muffle to a temperature of about 400° to 500° C to clean the oven walls by pyrolysis, and wherein the front wall includes an oven access opening therein and supports a pivotable door having a thermally insulated inner wall which overlies the opening to close off the same such that cold air leaking around the edge of the door forms reduced temperature areas on the inside face of the door and the oven wall surrounding the door, the improvement wherein said inside face of said oven door is lined with catalytic enamel and a strip of catalytic enamel lines the walls of the oven at a narrow zone immediately surrounding the access opening so as to substantially reduce the heating time for the self cleaning of the oven walls; the catalytic enamel being capable of withstanding the pyrolytic cleaning temperature.

2. The cooking oven according to claim 1, wherein an oven wall includes at least one air inlet opening to the exterior of said oven and wherein a narrow zone of the oven wall immediately surrounding said at least one cool air inlet is lined with said catalytic enamel on the surface facing the interior of said oven muffle.

3. The cooking oven according to claim 2, wherein the means for heating the oven includes a heating resistor and wherein said at least one air inlet opening comprises plural cool air inlets formed in the rear oven muffle wall, the ends of the heating resistor extending through said cool air inlet and wherein narrow zones of the muffle wall immediately surrounding said resistor ends form additional reduced temperature areas and are lined with said catalytic enamel on the surfaces of said zones facing the interior of said oven muffle.

* * * * *